US011896092B2

(12) United States Patent
Guyot et al.

(10) Patent No.: US 11,896,092 B2
(45) Date of Patent: Feb. 13, 2024

(54) BRACELET LINK

(71) Applicant: CARTIER INTERNATIONAL AG, Steinhausen (CH)

(72) Inventors: Dominique Guyot, Septfontaine (FR); Steeve Menetrier, La Chaux-de-Fonds (FR)

(73) Assignee: CARTIER INTERNATIONAL AG, Steinhausen (CH)

( * ) Notice: Subject to any disclaimer, the term of this patent is extended or adjusted under 35 U.S.C. 154(b) by 1160 days.

(21) Appl. No.: 16/603,664

(22) PCT Filed: Apr. 11, 2018

(86) PCT No.: PCT/EP2018/059234
§ 371 (c)(1),
(2) Date: Oct. 8, 2019

(87) PCT Pub. No.: WO2018/189219
PCT Pub. Date: Oct. 18, 2018

(65) Prior Publication Data

US 2020/0093229 A1 Mar. 26, 2020

(30) Foreign Application Priority Data

Apr. 11, 2017 (CH) ..... 00487/17

(51) Int. Cl.
*A44C 5/00* (2006.01)
*A44C 5/10* (2006.01)

(52) U.S. Cl.
CPC ..... *A44C 5/105* (2013.01)

(58) Field of Classification Search
CPC ..... A44C 5/105; A44C 5/107; F16G 15/04; F16G 15/12

(Continued)

(56) References Cited

U.S. PATENT DOCUMENTS 9,271,549 B2 * 3/2016 Elbe ..... A44C 5/107
2002/0023320 A1 * 2/2002 Thalheim ..... A44C 5/24 24/265 WS
2014/0353349 A1 * 12/2014 De Oliveira ..... G04B 37/1486 224/164

FOREIGN PATENT DOCUMENTS

CN 102281789 12/2011
JP 2001269205 10/2001

(Continued)

*Primary Examiner* — Jack W Lavinder
(74) *Attorney, Agent, or Firm* — DUANE MORRIS LLP; Gregory M. Lefkowitz; Brandon A. Chan

(57) ABSTRACT

The invention concerns a bracelet link suitable for forming a bracelet, the main direction of which defines a longitudinal axis, said link comprising: —a body passed through by a channel arranged in a direction transverse to the longitudinal axis, said channel being interrupted by a link portion provided in said body, in which a second link can engage, —a bar housed in the channel, said bar being capable of being moved in translation in the channel with respect to the body, between an assembled position in which the bar passes through the link portion and a free position in which it leaves the link portion free, —a locking member arranged so as to be movable in translation between a first position in which it locks the longitudinal position of the bar in order to hold it in the assembled position of same, and a second position in which the bar is movable in translation, and—an elastic member applying a force to the locking member that tends to hold it in the first position of same. According to the invention, the locking member is a pusher or is linked to a pusher such that it is capable of being moved to the second position of same in response to a pressure being applied directly to the pusher by a user.

19 Claims, 3 Drawing Sheets

(58) Field of Classification Search
USPC ..... 24/265 B, 265 WS; 59/82, 85
See application file for complete search history.

(56) References Cited

FOREIGN PATENT DOCUMENTS

| | | |
|---|---|---|
| JP | 2002199914 | 7/2002 |
| JP | 2007082597 | 4/2007 |

* cited by examiner

BRACELET LINK

CROSS-REFERENCE TO RELATED APPLICATIONS

This application is a § 371 national stage entry of International Application No. PCT/EP2018/059234, filed Apr. 11, 2018, which claims priority to Swiss Application No. 00487/17, filed on Apr. 11, 2017, the entire contents of which are incorporated herein by reference.

TECHNICAL FIELD

The present invention relates to the field of horology. It relates more specifically to a bracelet link suitable for forming a bracelet, the main direction of which defines a longitudinal axis. The link comprises a body traversed by a channel disposed in a transversal direction to the longitudinal axis. The channel is interrupted by a joining portion provided in the body of the link, in which a second link can engage. A bar is housed in the channel for the assembly of the link with an adjacent link. The bar is capable of moving in translation in the channel with reference to the body, between an assembled position, in which the bar passes through the joining portion, and a free position, in which it leaves the joining portion free.

BACKGROUND ART

The links of link bracelets are most often assembled from transversal bars or pins, which ensure the connection and the relative mobility of the links in relation to one another. In order to prevent the links from becoming detached unintentionally, different solutions have been proposed to secure the bars to at least one of the links with which they cooperate. These solutions likewise permit the bar to be extracted for the removal of a link, for a replacement or adjustment of the length. Typically, the bar must be pressed out or at best unscrewed, which requires the use of suitable tools and a certain dexterity. Thus, in general, a simple adjustment of the length of the bracelet must be performed by a professional, in order to avoid the risks of damaging the bracelet by incorrect handling.

Publication JP 2007-82597 A describes and illustrates an example of a bar of the type mentioned above implemented in relation to a locking member housed in the link. This locking member is arranged in order to act on the bar in the longitudinal direction of the bracelet and to retain it in its housing. For this purpose, the bar has an annular groove at its center, into which an extremity of the locking member may be inserted, under the effect of the action of an elastic member, in order to ensure locking of the bar. The locking member has the ability, furthermore, to be compressed in order to retract and release the bar. Extraction of the bar requires the insertion of a tool into the housing of the link in order to exert a pressure on the bar and to force the locking member to retract, in a manner similar to the manipulation necessary in relation to conventional bars that are not retained by a locking member.

It is desirable, however, for the wearer himself to be able to carry out such a manipulation. In fact, it is not always convenient to visit a professional.

Document EP1977658 proposes a reversible locking system, in which a locking member is mounted in a pivotable manner along an axis perpendicular to the axis of the bar. The locking member is positioned so as to be able to engage in a groove provided on the surface of the bar. The locking member comprises a non-cylindrical portion which, depending on its angular position, engages in the groove or is disengaged therefrom. Although the idea is interesting, it is still necessary to have recourse to a tool such as a screwdriver in order to cause the locking member to pivot and to bring about locking/unlocking of the bar. It will also be appreciated from this document that, in order to secure the rotation of the locking member, it is necessary to exert an axial pressure on the screw, combined with the rotation of this latter. The axial pressure induces a change in the level of the locking member, which makes rotation possible. Only the rotation of the locking member permits the bar to be locked or released.

The aim of the present invention is to propose an improved solution, permitting utilization that is simpler and without tools.

DISCLOSURE OF THE INVENTION

More precisely, the invention relates to a bracelet link suitable for forming a bracelet, the main direction of which defines a longitudinal axis. The link comprises:

- a body traversed by a channel disposed in a transversal direction to the longitudinal axis, said channel being at least partially interrupted by a joining portion provided in said body, in which a second link can engage,
- a bar housed in the channel, said bar being capable of being moved in translation in the channel with reference to the body between an assembled position, in which the bar passes through the joining portion, and a free position, in which it leaves the joining portion free,
- a locking member arranged so as to be mobile in translation in the body between a first position, in which it locks the longitudinal position of the bar in order to hold it in the assembled position, and a second position, in which the bar is movable in translation, and
- an elastic member applying a force to the locking member that tends to hold it in its first position.

According to the invention, the locking member is a push button or is linked to a push button such that it is capable of being moved to its second position in response to the application of a pressure directly to the push button by a user.

The invention also relates to a bracelet containing at least two links according to the invention, as well as a method for lengthening or shortening such a bracelet.

BRIEF DESCRIPTION OF THE DRAWINGS

Other details of the invention will emerge more clearly from reading the following description, made with reference to the drawing annexed hereto, in which.

EMBODIMENTS OF THE INVENTION

Figure 1:
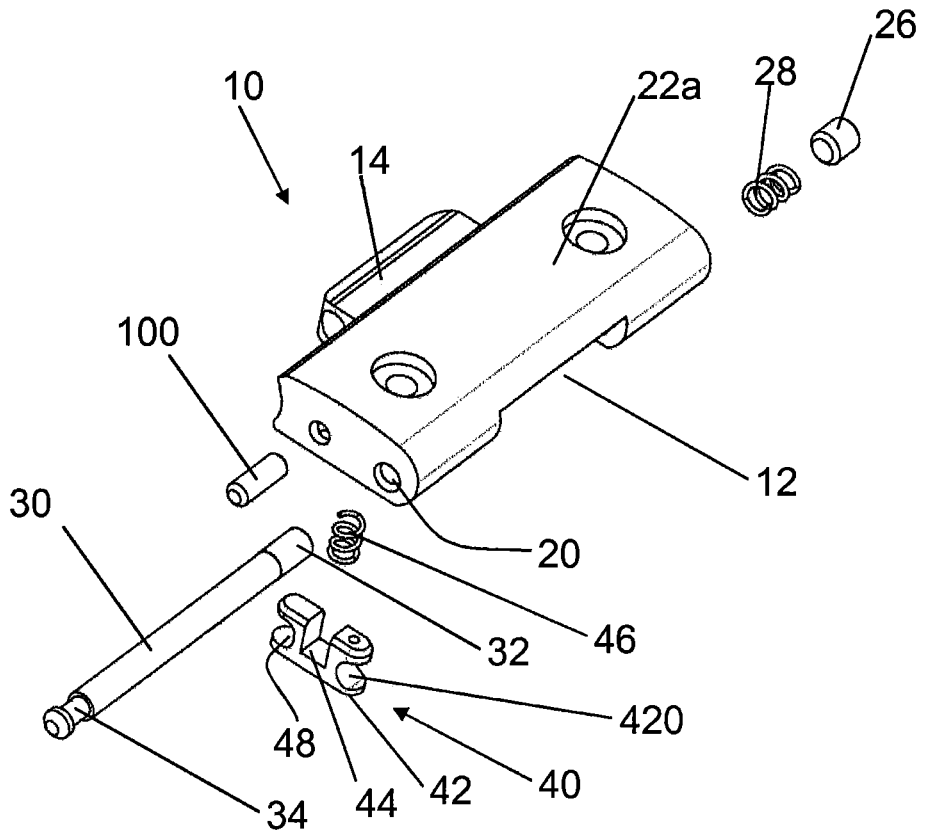
FIG. 1 is an exploded view of a link according to a preferred embodiment of the invention.
Figure 2A:
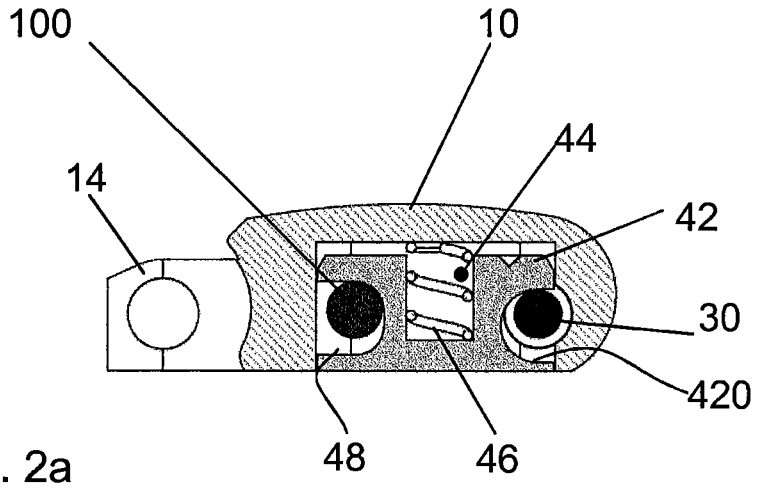
FIGS. 2*a* and 2*b* are views in longitudinal section of the link in FIG. 1, respectively in the free position and in the pushed-in position.
Figure 2B:
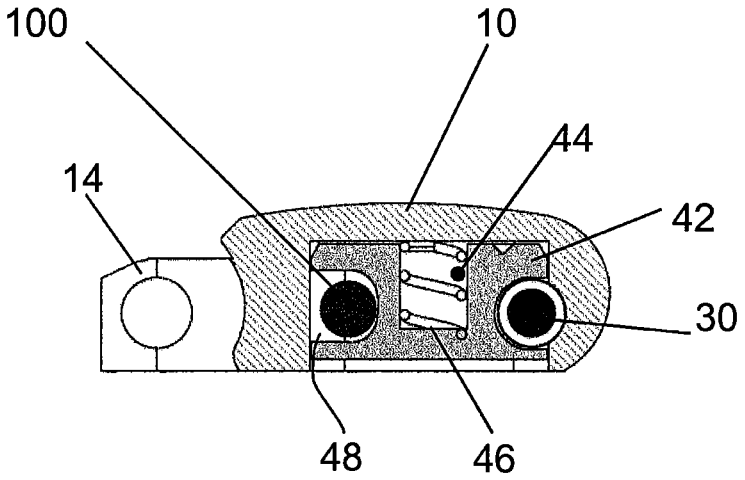
Figure 3A:
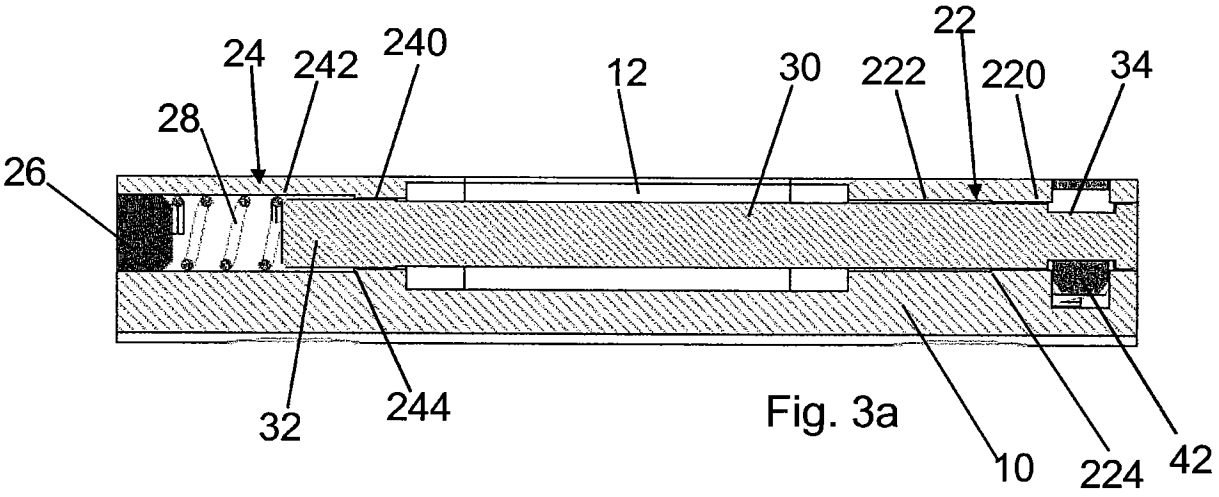
FIGS. 3*a* and 3*b* are views in transverse section of the link in FIG. 1, respectively in the free position and in the pushed-in position.
Figure 3B:
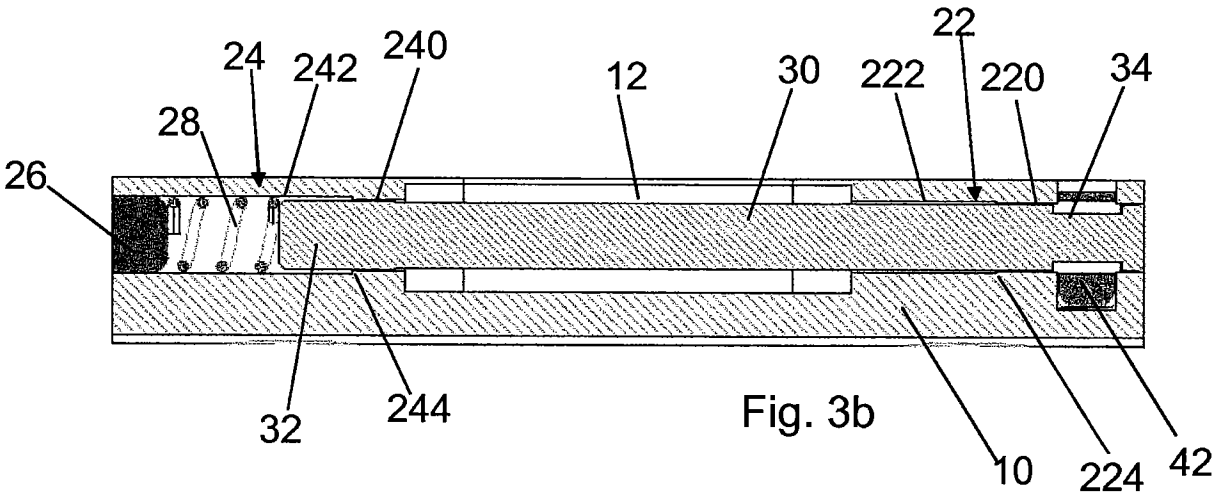

Depicted in FIG. 1 is a bracelet link according to the invention, of which the different component parts are shown in an exploded view. This link has the ability to be connected to other compatible links in order to form a bracelet. In the rest of the application, the main direction of the bracelet in which the link participates is defined as being the longitudinal axis.

The link comprises a body 10 of substantially parallelepipedal form, albeit without this being limitative. The body 10 is traversed by a channel 20 disposed in a transversal direction to the longitudinal axis. At least one joining portion 12 or, as necessary according to the construction of the bracelet, a plurality of joining portions is provided in the body 10. This joining portion 12 permits the engagement of a second link by a corresponding male part that this second link contains. In this particular case, the body 10 of the link also comprises a male part 14 intended to cooperate with a joining portion 12 of another link, or with a watch case. The channel 20 is interrupted or intersected, at least partially, by the joining portion 12.

More specifically, the channel 20 comprises a first part 22, opening at its two extremities, on one side into the joining portion 12 and on the other side on the exterior of the link. This first part 22 of the channel 20 has a guidance zone 220 situated on the exterior side of the link, having a diameter d1, and a second zone 222 situated on the joining portion 12 side, having a diameter d2>d1. Between these two zones, the change in diameter forms an edge 224 of which the role will become clearer below.

The channel 20 also comprises a second part 24, opening on the joining portion 12 side, but closed on the other side by a stopper 26. This second part 24 of the channel 20 also has a guidance zone 240 situated on the joining portion 12 side of the link, having a diameter d3, and a second zone 242 situated on the exterior of the link, having a diameter d4>d3. d3 may be substantially equal to d2. Between these two zones, the change in diameter forms an edge 244.

A spring 28 is housed in the second part 24 of the channel 20, where it is maintained between the stopper 26 and the edge 244 formed by the change in diameter between the zones having a diameter d4 and d3.

The link further comprises a bar 30 housed in the channel 20. The bar 30 is capable of moving in translation in the channel 20 with reference to the body 10 between an assembled position, in which the bar 30 passes through the joining portion 12, and a free position in which it leaves or may leave the joining portion 12 free. Thus, in the assembled position, the bar 30 may cooperate with a second link in order to connect them together. Conversely, in the free position, a second link, which would have been connected to the first link, may be removed.

More specifically, the bar 30 comprises parts having different diameters. For most of its length, the bar 30 exhibits a diameter D1, which is slightly smaller than the smallest diameter d1 of the channel 20, in order for the guidance zone 220 of the channel 20 having a diameter d1 to be able to guide the bar 30 in its translation.

At its extremity that is intended to be positioned in the second part 24 of the channel 20, when the bar is in the locked position, the bar 30 comprises a portion 32 having a diameter D2>D1. D2 is slightly smaller than d3, in order for the guidance zone 240 of the channel 20 having a diameter d3 to be able to guide this portion 32 in its translation. It should be noted that the bar 30 is not in direct contact with the channel 20, other than in the guidance zones 220 and 240, in order to reduce the friction induced by the translation of the bar 30. D2 is greater than d1 and smaller than d2, in order for the bar 30 to be able to slide in the first part 22 of the channel 20 as far as the abutment of the extremity of the bar 30, having a diameter D2, against the edge 224.

The bar 30 further comprises an annular groove 34 provided on the cylindrical surface thereof. The groove exhibits a diameter D3<D1, and it is intended to cooperate with a locking member 40 described below.

Indeed, the link according to the invention further comprises said locking member 40 arranged in order to move between a first position, in which it locks the longitudinal position of the bar 30 in order to hold it in the assembled position, and a second position, in which the bar 30 is free to move in translation. In this first position, the locking member cooperates with the groove 34, specifically with its lateral walls, at least with the lateral wall situated on the side of the joining portion, under the action of the spring 28. In the second position, the locking member no longer cooperates with the groove 34, permitting the passage of the bar.

According to the invention, the locking member 40 is movable in translation with reference to the body 10 of the link and passes from its first position to its second position by a displacement in translation.

More specifically, the locking member 40 is a push button arranged inside a cavity provided on the surface of said body 10, preferably on its face intended to be in contact with the wearer of the bracelet.

It is, of course, possible to provide as an alternative that a separate push button is arranged in the link by being connected, directly or indirectly, to the locking member 40 so as to be able to cooperate with this latter, in particular to be able to displace it from its first position towards its second position in response to a pressure exerted on the push button by a wearer. Advantageously, the pressure is exerted directly on an actuating surface of the push button by a finger of the wearer or by any other suitable means.

In all cases, it is advantageous to provide that the pressure exerted by the wearer on the push button may exhibit a direction oriented substantially in the direction of the translation that the locking member 40 exhibits when it moves between its first position and its second position.

The push button is associated with a latch 42, dimensioned in order to be able to be engaged in the groove 34 of the bar 30. In the preferred embodiment, the latch 42 and the push button are made as a single piece, although it could be formed from assembled distinct pieces. The latch 42 contains an opening 420 permitting the passage of the bar 30 during a displacement in translation along the axis of the bar 30 if the latter is substantially centered with reference to the opening 420.

According to a preferred embodiment, the opening 420 has a circular portion, of which the diameter is bigger than D1.

The push button further contains a housing 44 permitting the arrangement of an elastic member 46 exerting a force on the locking member 40 that tends to hold it in the first position of same, the latch being situated in the groove 34. This elastic member 46 may take the form of a spring interposed between the body 10 of the link and the push button.

The push button further comprises a guiding opening 48, in which is housed a guiding pin 100 that is integral with the body 10 of the link. The opening is of oblong shape in order to guide the translation of the push button. The cooperation between the guiding opening 48 and the guiding pin 100 guarantees that the push button is correctly positioned, especially when it is in its first position. The push button is then pressing against the guiding pin 100 and on the bar 30 and is thus perfectly positioned, flush with the link and stable.

The fact that the push button is flush with the link in the first position of the locking member, that is to say is situated substantially in alignment with an external surface of the link, provides an impression of the link being of a high quality to the wearer of the bracelet. However, the invention may be implemented in a satisfactory manner since the push button has an actuating surface situated in proximity to the concerned external surface of the link, in such a way that a wearer may exert a pressure on it without the need to utilize a tool for this purpose, even if, of course, the utilization of a tool remains possible.

It will thus be appreciated that the part of the bar 30 having a diameter D2 is unable to penetrate into the zone of the channel 20 having a diameter d1. Consequently, the bar 30 is mounted on the side of the second part of the channel 20, the push button already being mounted in its cavity. The bar 30 is arranged so as to adopt a position through the opening 420 of the latch 42. The spring 28 is then disposed in the second part 24 of the channel 20, before closing the latter by means of the stopper 26, which is then embedded at the surface of the body 10 and rendered invisible at the surface of the link. The stopper could be screwed in order to obtain an easily removable solution.

Under the action of the elastic member 46, the push button is pressed into its first position, in which the latch 42 presses against the base of the groove 34 of the bar 30 having a diameter D3. The bar 30 is then inserted into the body 10 and passes through the joining portion 12, permitting an assembly with another link. The bar 30 is then in the assembled position, and its position is secured transversely.

By pressing on the push button when the bar 30 is in the assembled position, the latter is ejected automatically out of the channel 20 under the action of the spring 28 as soon as the opening of the latch 42 is in alignment with the bar 30. The displacement in translation of the bar 30 is limited by the extremity of the second zone 32 of the bar 30, having a diameter D2, coming into abutment against the edge 224. The bar 30 may not be detached completely, which prevents it from being lost. It remains sufficiently guided to limit the forces and the deformations. The bar 30 is thus in the free position, making it possible to remove a link from the joining portion 12 or to insert a link.

It is sufficient to push the bar 30 back into the channel 20 in order to return it to the assembled position. As soon as the groove 34 returns to the level of the latch 42, the elastic member 46 automatically brings the locking member 40 back to its first position. Operation of the locking member 40 is not called for in order to lock again the position of the bar 30.

By positioning a plurality of links equipped with such a system side by side, it is very easy for a wearer to add/remove a link and thus to adjust the length of his bracelet. The addition and the removal of links are effected without any tool in a highly reliable and secure manner.

The above description is proposed by way of non-exhaustive example, and a person skilled in the art will be able to draw on this in order to adapt it to various types of designs of link bracelets, having one or a plurality of ranges of links, as the need arises, by combining a plurality of locking members.

The invention claimed is:

1. A link, suitable for forming a bracelet having a main direction which defines a longitudinal axis, said link comprising:

a body traversed by a channel disposed in a transversal direction to said longitudinal axis, said channel being interrupted by a joining portion provided in said body, in which a second link can engage, a bar housed in said channel, said bar being capable of being moved in translation in said channel with reference to said body, between an assembled position, in which said bar passes through said joining portion, and a free position, in which said bar leaves said joining portion free, a locking member arranged so as to be mobile in translation in said body between a first position, in which said locking member locks said bar in its assembled position, and a second position, in which said bar is movable in translation, said locking member being a push button or being linked to a push button such that said locking member is capable of being moved to its second position in response to a pressure being applied directly to said push button by a user, and an elastic member applying a force to said locking member that tends to hold said locking member in its first position, wherein the link further comprises a spring interposed between said bar and said body, arranged in order to exert on said bar a force tending to push it in translation from said assembled position towards said free position.

2. The link of claim 1, wherein said push button is situated in proximity to an external surface of said body such that the user is able to operate said push button without a tool.

3. The link of claim 2, wherein said push button has an actuating surface arranged substantially in alignment with said external surface of said body in said first position of said locking member.

4. A bracelet containing at least two links as claimed in claim 3.

5. The link of claim 2, wherein said locking member and said push button are made as a single piece.

6. The link of claim 2, wherein said locking member is movable in translation in a transversal direction with reference both to said longitudinal axis and to said channel.

7. The link of claim 2, wherein said locking member comprises a latch with an ability to be engaged in a groove provided on a cylindrical surface of said bar.

8. The link of claim 2, wherein said bar comprises a portion having a diameter D1 and a portion having a diameter D2>D1, and wherein said channel comprises a zone having a diameter d1 and a zone having a diameter d2>d1, the change in diameter between said zones having a respective diameter d1 and d2 forming an edge, and wherein d1<D2<d2 so that said edge forms an abutment for said bar.

9. The link of claim 2, further comprising a spring interposed between said bar and said body, arranged in order to exert on said bar a force tending to push it in translation from said assembled position towards said free position.

10. A bracelet containing at least two links as claimed in claim 2.

11. The link of claim 1, wherein said locking member and said push button are made as a single piece.

12. The link of claim 11, wherein said locking member is movable in translation in a transversal direction with reference both to said longitudinal axis and to said channel.

13. The link of claim 1, wherein said locking member is movable in translation in a transversal direction with reference both to said longitudinal axis and to said channel.

14. The link of claim 1, wherein said locking member comprises a latch with an ability to be engaged in a groove provided on a cylindrical surface of said bar.

15. The link of claim 1, wherein said bar comprises a portion having a diameter D1 and a portion having a diameter D2>D1, wherein said channel comprises a zone having a diameter d1 and a zone having a diameter d2>d1, the change in diameter between said zones having a respective diameter d1 and d2 forming an edge, and wherein d1<D2<d2 so that said edge forms an abutment for said bar.

16. The link of claim 1, wherein said channel comprises guidance zones dimensioned so as to guide said bar in translation, and second zones dimensioned so as to allow said bar to translate in the absence of friction with said second zones.

17. A bracelet containing at least two links as claimed in claim 1.

18. A method for lengthening or for shortening a link bracelet according to claim 17, containing a link of which said bar is in said assembled position, said method comprising a step of actuation in translation of said locking member, said actuation in translation resulting in an, at least partial, automatic ejection of said bar.

19. A method for lengthening or for shortening a link bracelet as claimed in claim 17, containing a link of which said bar is in said free position, said method comprising a step in the course of which said bar is pushed back into said channel, said locking member being brought automatically to its first position when said bar reaches said assembled position.

* * * * *